US007500478B2

(12) United States Patent
Yeh

(10) Patent No.: US 7,500,478 B2
(45) **Date of Patent: *Mar. 10, 2009**

(54) PAINTBALL GUN PERCUSSION STRUCTURE

(75) Inventor: Hsin-Cheng Yeh, Tainan Hsien (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 251 days.

This patent is subject to a terminal disclaimer.

(21) Appl. No.: 11/549,246

(22) Filed: Oct. 13, 2006

(65) Prior Publication Data

US 2008/0087266 A1 Apr. 17, 2008

(51) Int. Cl.
*F41B 11/00* (2006.01)

(52) U.S. Cl. ..... 124/73; 124/75; 124/77

(58) Field of Classification Search ..... 124/73–77
See application file for complete search history.

(56) References Cited

U.S. PATENT DOCUMENTS 5,769,066 A * 6/1998 Schneider ..... 124/75
5,778,868 A * 7/1998 Shepherd ..... 124/76
2003/0005918 A1* 1/2003 Jones ..... 124/70
2004/0255923 A1* 12/2004 Carnall et al. ..... 124/73
2005/0115554 A1* 6/2005 Jones ..... 124/74

* cited by examiner

*Primary Examiner*—Troy Chambers
*Assistant Examiner*—Gabriel J Klein
(74) *Attorney, Agent, or Firm*—WPAT, P.C.; Anthony King

(57) ABSTRACT

A paintball gun percussion structure includes a gun body, a triggering barrel and a rear guiding rod. The gun body has an air chamber adapted to receive the triggering barrel and the rear guiding rod. The air chamber comprises a first air passage way and a second air passage way. The triggering barrel comprises a stopper located between the first air passage way and the second air passage way of the air chamber. The rear guiding rod has a piston corresponding to an air inlet of the triggering barrel. By means of the first air passage way and the second air passage way to activate the stopper reciprocating movement in the air chamber to fire a paintball bullet.

5 Claims, 7 Drawing Sheets

PAINTBALL GUN PERCUSSION STRUCTURE

BACKGROUND OF THE INVENTION

1. Field of the Invention

The present invention relates to a paintball gun percussion structure, in particular to a triggering barrel provided with a stopper located between a first air passage way and a second air passage way of a barrel to achieve loading and firing operation.

2. Description of the Prior Art

As shown in FIG. 6, a conventional paintball gun comprises a barrel B, a piston barrel C and a push rod D. The piston barrel C is disposed at a middle section of the barrel B, and the push rod D is disposed at a rear section of the barrel B. This design makes the gun in a two-part structure. Air is pumped into the middle section and the rear section of the barrel B, respectively. The air in the middle section of the barrel B is to push the piston barrel C to slide along the barrel B and to load the bullet, and the air in the rear section of the barrel B is to fire the bullet out of the barrel B. This design wastes some of high pressured air to load the bullet.

As shown in FIG. 7, another conventional paintball gun comprises a barrel E, a front outer barrel F and a rear outer barrel G, a triggering barrel H and a rear guiding rod I. The front outer barrel F and the rear outer barrel G are disposed in the barrel E. The triggering barrel H is accommodated in the front outer barrel F and the rear outer barrel G. The rear guiding rods I is disposed at one end of the triggering barrel H. By filling high pressured air into the rear outer barrel G to move the triggering barrel H towards the front outer barrel F, leading the triggering barrel H to depart from the rear guiding rod I. The air stored in the rear outer barrel G is sent to the triggering barrel H to shoot a paintball bullet. This design is composed of too many parts, which increases the cost of manufacture and is difficult to maintain.

SUMMARY OF THE INVENTION

It is the primary objective of the present invention to provide a paintball gun percussion structure, which separates the rear section of a triggering barrel and a guiding rod after shooting to avoid any interference.

It is another objective of the present invention to provide a paintball gun percussion structure, which increases the shooting time.

It is a further objective of the present invention to provide a paintball gun percussion structure, which uses few air seals to minimize the friction of parts and increase the movement.

It is still a further objective of the present invention to provide a paintball gun percussion structure, which is cost-effective.

According to the present invention, there is provided a paintball gun percussion structure comprising a gun body comprising a hollow barrel, said barrel having an air chamber therein, said air chamber comprising a first air passage way and a second air passage way; a triggering barrel disposed in said barrel being a hollow barrel and comprising an air inlet at one end, an air outlet at another end, and a stopper at an outer surface thereof, said stopper being located between said first air passage way and said second air passage way; and a rear guiding rod secured at one end of said air chamber comprising a piston at a front end thereof to engage with said air inlet of said triggering barrel.

BRIEF DESCRIPTIUON OF THE DRAWINGS

DETAILED DESCRIPTION OF THE PREFERRED EMBODIMENT

Figure 1:
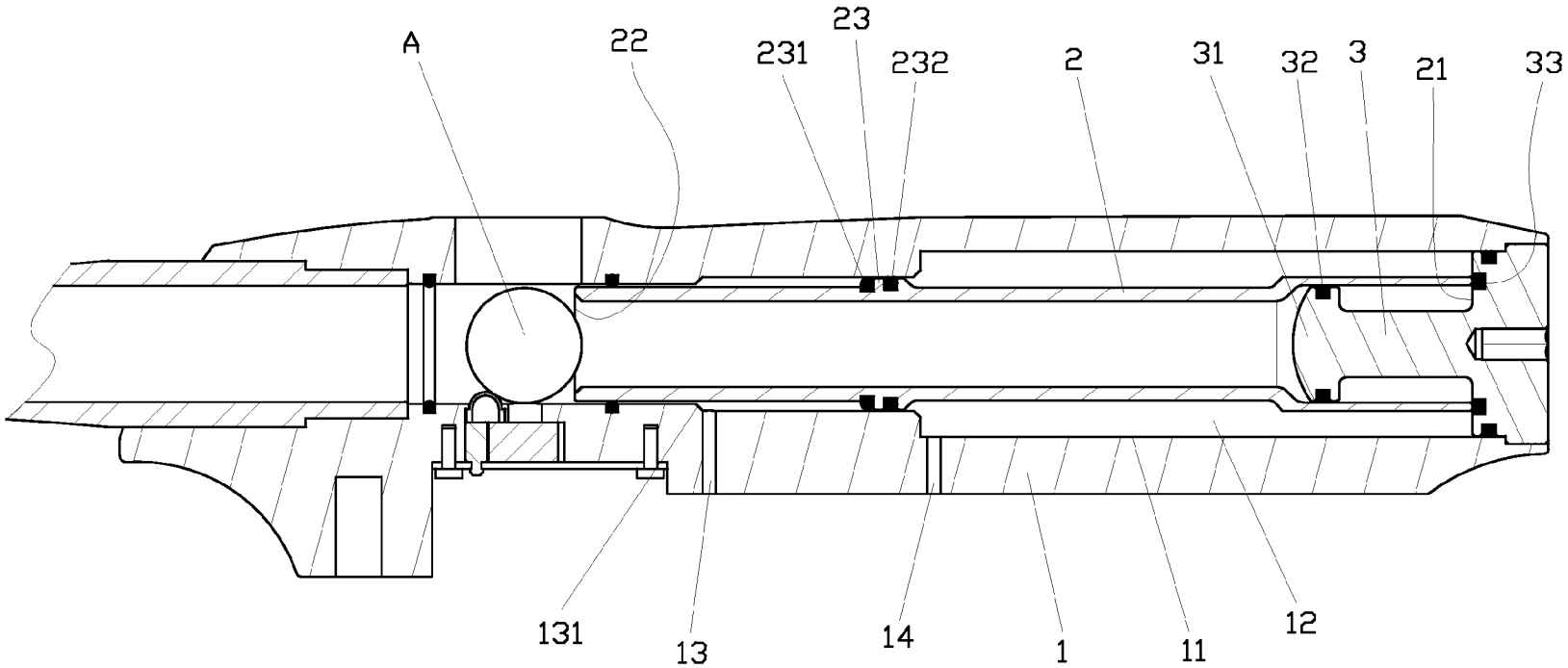
FIG. 1 is a side cross-sectional view of the present invention.

As shown in FIG. 1, a preferred embodiment of the present invention comprises a gun body 1, a triggering barrel 2, and a rear guiding rod 3.

The gun body 1 comprises a hollow barrel 11 having an air chamber 12 therein. The air chamber 12 comprises a first air passage way 13 and a second air passage way 14. The first air passage way 13 is provided with a stop ring 131 at the front end thereof The triggering barrel 2 disposed in the barrel 11 is a hollow barrel. The triggering barrel 2 has an air inlet 21 at one end and an air outlet 22 at the other end thereof. A stopper 23 is formed on the outer surface of the triggering barrel 2. A buffer ring 231 is provided in front of the stopper 23, and an air seal 232 is provided in back of the stopper 23. The stopper 23 is located between the first air passage way 13 and the second air passage way 14, so that the movement of the stopper 23 is limited between the first air passage way 13 and the second air passage way 13.

The rear guiding rod 3 is secured at one end of the air chamber 12 of the barrel 11, and comprises a piston 31 at the front end thereof. An air seal 32 is provided on the piston 31 which corresponds to the air inlet 21 of the triggering barrel 2. The rear end of the rear guiding rod 3 is provided with a buffer ring 33 which buffers the backlash force from the triggering barrel 2.

Figure 2:
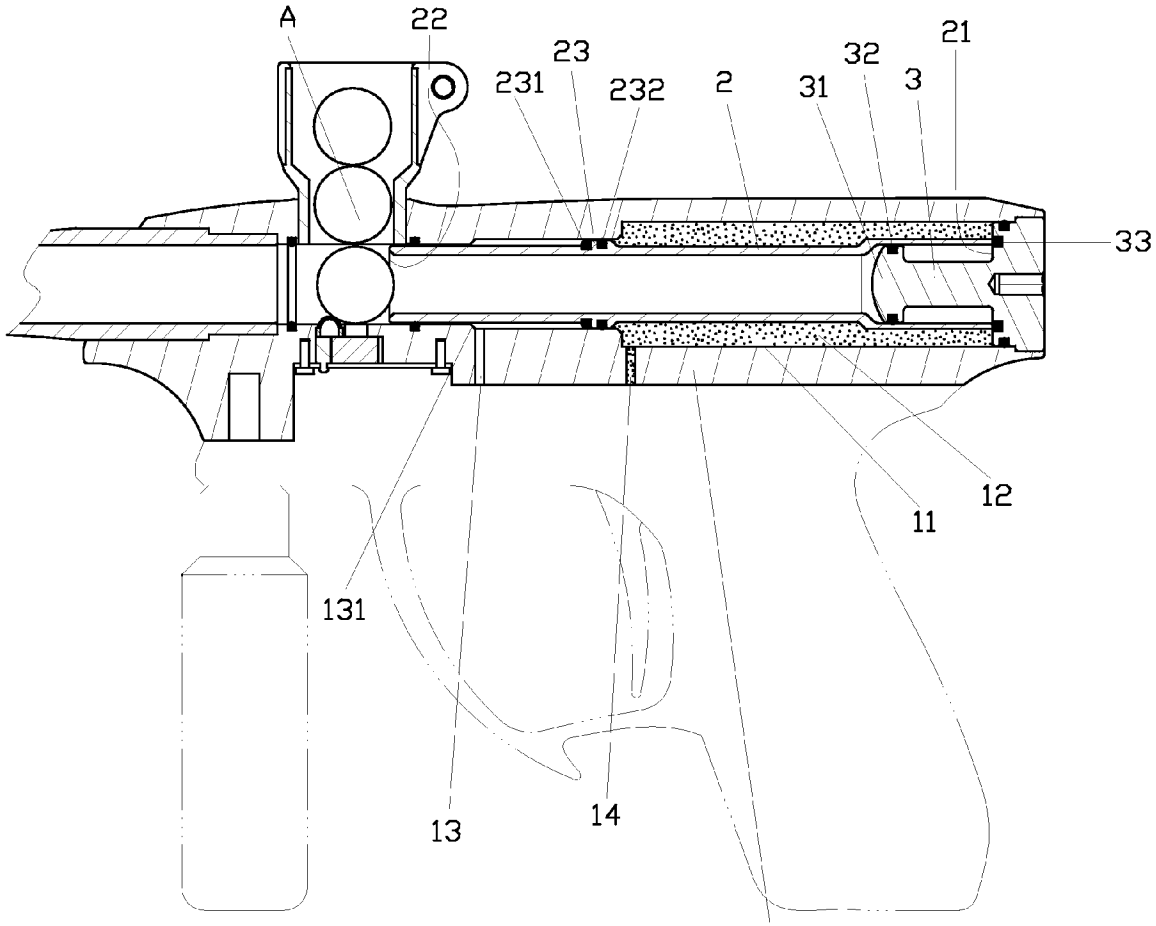
FIG. 2 is a side cross-sectional view showing that an air inlet of a triggering barrel engages with a buffer ring of a rear guiding rod and high pressured air is accumulated in an air chamber.
Figure 3:
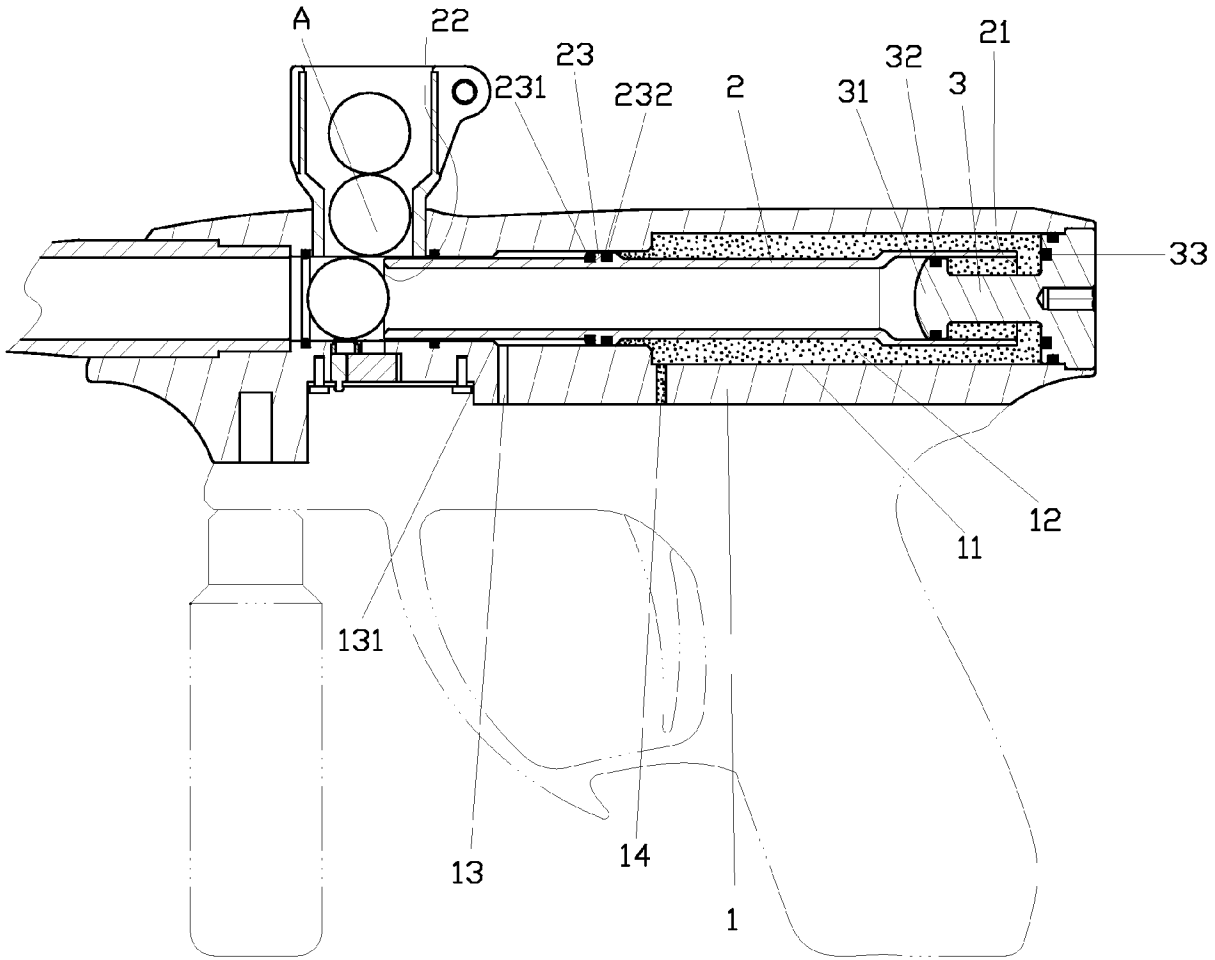
FIG. 3 is a view similar to FIG. 2 showing that the air inlet is moved away from the buffer ring.
Figure 4:
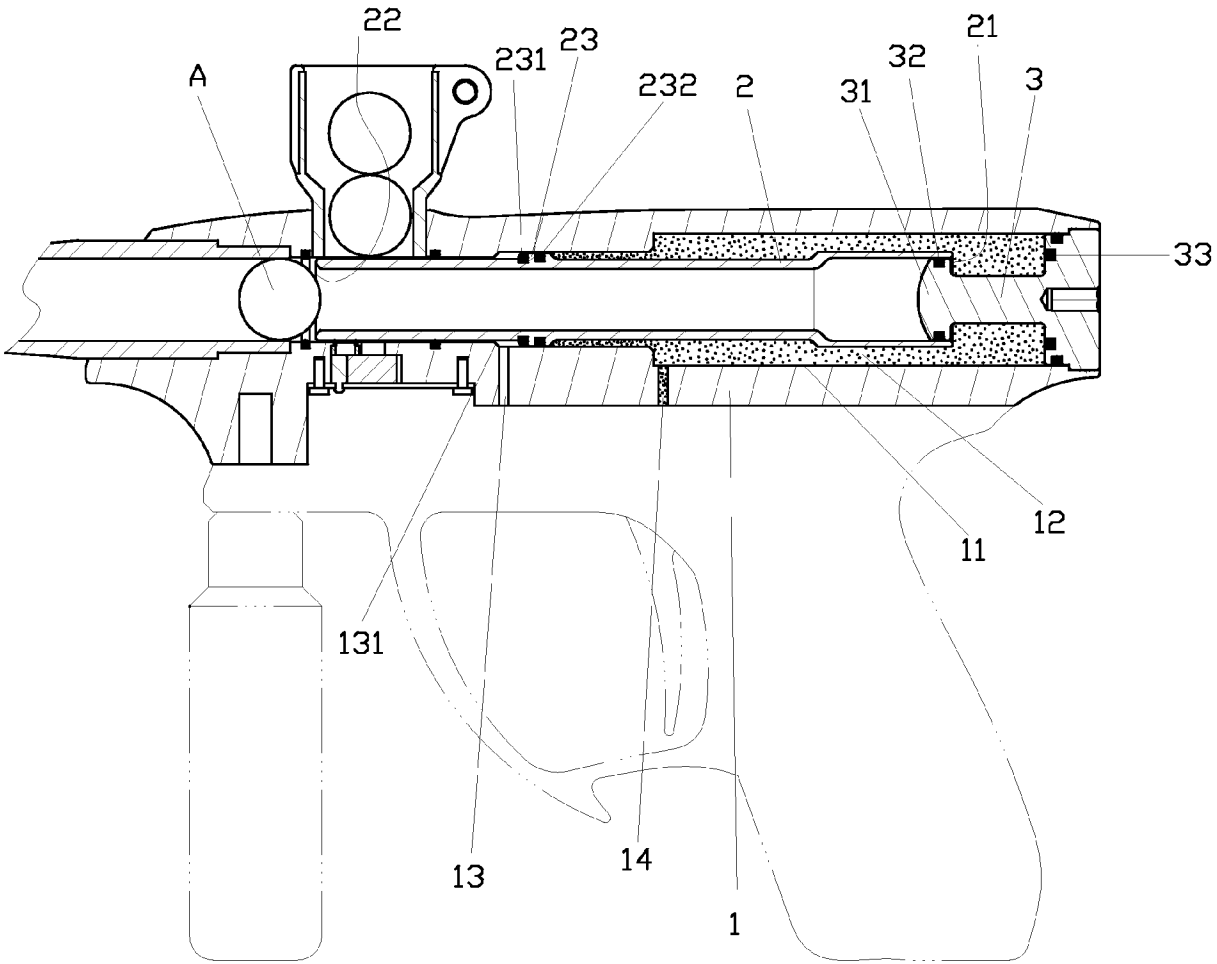
FIG. 4 is a view similar to FIG. 2 showing that the air inlet is moved away from the air seal.
Figure 5:
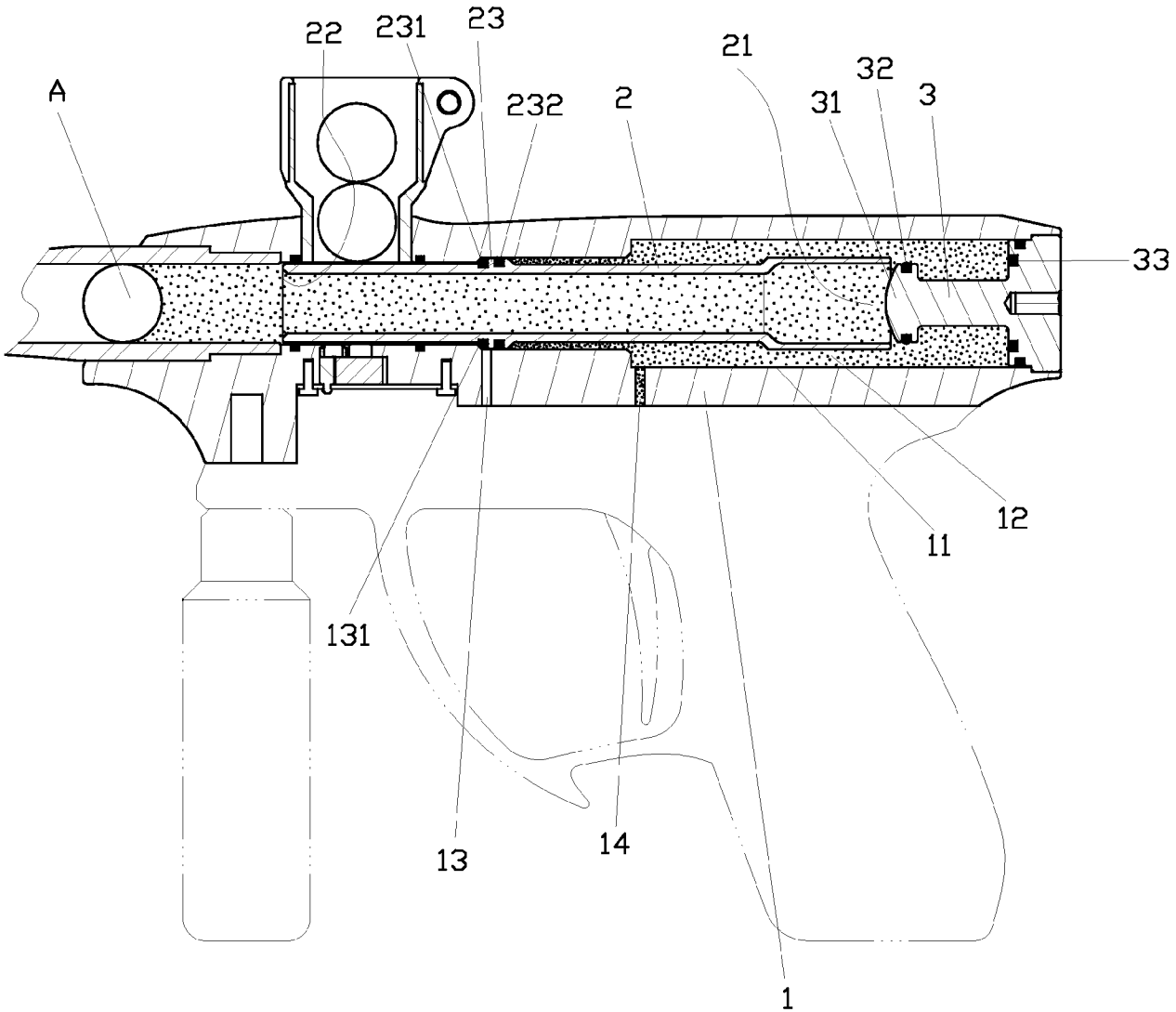
FIG. 5 is a view similar to FIG. 2 showing that the triggering barrel is stopped by a stop ring in front of a first air passage way in a shooting status.
Figure 6:
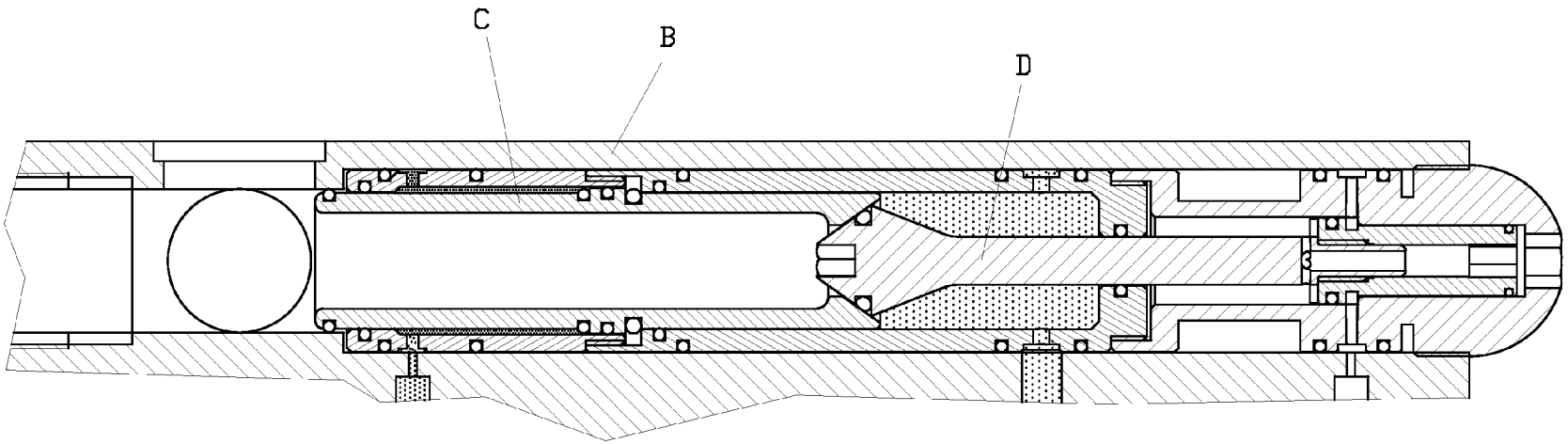
FIG. 6 (PRIOR ART)
FIG. 6 is a side cross-sectional view of the prior art.
Figure 7:
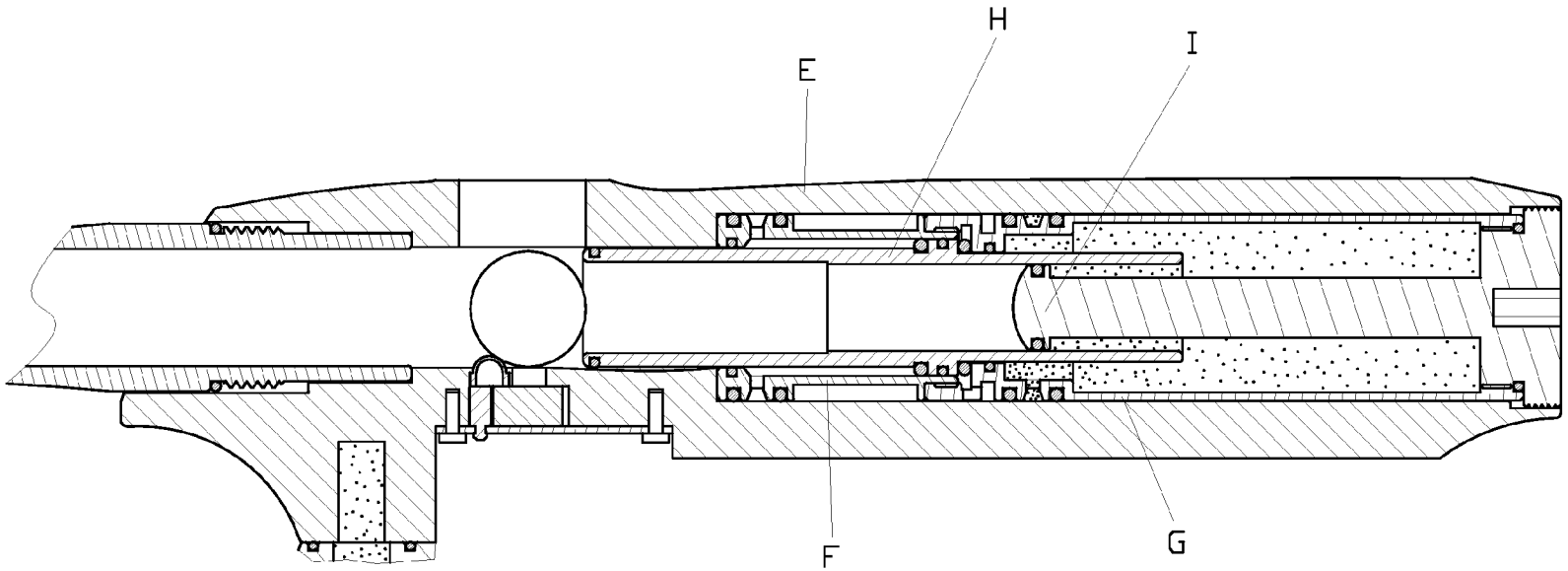
FIG. 7 (PRIOR ART)
FIG. 7 is a side cross-sectional view of another prior art.

To fire the paintball gun, as shown in FIG. 2, both the first air passage way 13 and the second air passage way 14 are linked to a high pressure air supply, in such a manner that the second air passage way 14 inputs the high air pressure into the air chamber 12 of the gun body 1, and the first air passage way 13 outputs the air. The air seal 232 of the triggering barrel 2 engages with the inner wall of the air chamber 12, and the air seal 32 of the rear guiding rod 3 engages with the air inlet 21 of the triggering barrel 2 to form a sealed space to store high pressured air. The continuous input high pressured air into the air chamber 12 will increase the pressure in the air chamber 12 to force the stopper 23 of the triggering barrel 2 to move towards the first air passage way 13. The triggering barrel 2 is linked to move along with the stopper 23, which leaves a gap between the air inlet 21 of the triggering barrel 2 and the buffer ring 33 of the rear guiding rod 3. Meanwhile, the high pressured air in the air chamber 12 squeezes the air inlet 21 and the stopper 23 respectively to force the stopper 13 towards the stop ring 131 in front of the first air passage way 13 and the air inlet 21 of the triggering barrel 2 towards the air seal 32 of the rear guiding rod 3, which links the triggering barrel 2 to push the paintball A to the firing position, as shown in FIG. 4. When the stopper 23 of the triggering barrel 2 reaches to the stop ring 131 in front of the first air passage way 13, as shown in FIG. 5, the air inlet 21 departs from the piston 31 of the rear guiding rod 3 and disengages from the air seal 32. The stored high pressured air comes in from the air inlet 21 and outputs from the air outlet 22 to fire the paintball A.

After shooting, high pressured air starts to input through the first air passage way 13 to push the stopper 23 away from the first air passage way 13 towards the second air passage way 14, and the air inlet 21 of the triggering barrel 2 moves towards the piston 31 until the end of the triggering barrel 2 reaches to the buffer ring 33 and the air seal 32 of the rear guiding rod 3 engages with the air inlet 21, that completes the shooting procedure.

What is claimed is:

1. A paintball gun percussion structure, comprising:

a gun body comprising a hollow barrel, said hollow barrel having an air chamber therein, said gun body further comprising a first air passage way and a second air passage way;

a triggering barrel disposed in said hollow barrel of said gun body and comprising an air inlet at a proximal end, an air outlet at a distal end, and a stopper at an outer surface thereof, said stopper being located between said first air passage way and said second air passage way;

wherein the air chamber is disposed proximal to said stopper;

wherein said triggering barrel has no holes on a wall of the triggering barrel, and a rear guiding rod secured at one end of said air chamber of said barrel comprising a piston at a front end thereof to engage with said air inlet of said triggering barrel.

2. The paintball gun percussion structure, as recited in claim 1, wherein an air seal is provided at a rear edge of said stopper.

3. The paintball gun percussion structure, as recited in claim 1, wherein a buffer ring is provided at a front edge of said stopper.

4. The paintball gun percussion structure, as recited in claim 1, wherein said rear guiding rod comprises an air seal at the front end thereof.

5. The paintball gun percussion structure, as recited in claim 1, wherein said rear guiding rod comprises a buffer ring at a rear end thereof.

* * * * *